US005816900A

United States Patent [19]

Nagahara et al.

[11] Patent Number: 5,816,900

[45] Date of Patent: Oct. 6, 1998

[54] APPARATUS FOR POLISHING A SUBSTRATE AT RADIALLY VARYING POLISH RATES

[75] Inventors: Ron J. Nagahara; Dawn M. Lee, both of San Jose, Calif.

[73] Assignee: LSI Logic Corporation

[21] Appl. No.: 895,659

[22] Filed: Jul. 17, 1997

[51] Int. Cl.[6] ..... B24B 19/22; B24B 57/02

[52] U.S. Cl. ..... 451/285; 451/60; 451/446

[58] Field of Search ..... 451/60, 446, 505, 451/288, 287, 290, 285, 289, 41, 488

[56] References Cited

U.S. PATENT DOCUMENTS

| | | | |
|---|---|---|---|
| 4,490,948 | 1/1985 | Hanstein et al. | 451/446 |
| 5,531,635 | 7/1996 | Mogi | 451/72 |
| 5,554,064 | 9/1996 | Breivogel et al. | 451/446 |
| 5,569,062 | 10/1996 | Karlsrud | 451/285 |
| 5,643,067 | 7/1997 | Katsuoka et al. | 451/444 |
| 5,658,185 | 8/1997 | Morgan, III et al. | 451/60 |
| 5,679,063 | 10/1997 | Kimura et al. | 451/287 |

FOREIGN PATENT DOCUMENTS

| | | | |
|---|---|---|---|
| 1321161 | 12/1989 | Japan | 451/446 |
| 2100321 | 4/1990 | Japan | 451/446 |

*Primary Examiner*—Robert A. Rose
*Attorney, Agent, or Firm*—Kevin L. Daffer; Conley, Rose & Tayon

[57] ABSTRACT

A polishing apparatus and method is disclosed, whereby fluid is delivered at dissimilar flow rates and pressures across a wafer. The fluid is delivered either directly to the wafer or through a polishing pad. Changing the fluid delivery allows the removal properties of the fluid to polish material from the wafer surface based on the location of that material relative to the center of the wafer. The fluid delivery system and the polishing pad oscillate relative to a rotating wafer. The radius of oscillation is relatively small compared to the size of the wafer to allow removal along one or more concentric rings and/or circles across the wafer.

21 Claims, 4 Drawing Sheets

APPARATUS FOR POLISHING A SUBSTRATE AT RADIALLY VARYING POLISH RATES

BACKGROUND OF THE INVENTION

1. Field of the Invention

This invention relates to polishing in general and, more particularly, to a polishing apparatus for removing, with or without a polishing pad, material from a substrate (or wafer) surface at dissimilar rates depending on the polish position relative to the center of the wafer.

2. Description of Related Art

The concept of polish is generally well known. A substrate surface can be polished using a fluid combined with an abrasive pad to present both chemical and mechanical removal. If the pad is rotated with enough abrasive force, surface material can be dislodged or ablated from across the substrate which, according to one example, can be a semiconductor wafer. The fluid and/or pad extending across the wafer help dislodge, for example, surface contaminants, and/or raised topological features from the surface. The abrasive pad is preferably used containing materials which roughen the wafer surface so as to enhance effectiveness of the chemical etchant within the fluid. The pad can rotate relative to the wafer surface. Combined with the pad may be a chemically reactive solution, commonly referred to as "slurry". A combination of polishing pad with chemical slurry is recognized in the industry as a chemical mechanical polish ("CMP").

A typical CMP process involves placing the wafer face-down on the polishing pad which is fixedly attached to a rotatable table. Elevationally raised portions of a thin film existing on the wafer surface is placed in direct contact with the rotating pad. A carrier may be used to apply downward pressure against the backside surface of the wafer possibly concurrent with upward pressure against the backside surface of the pad.

The slurry may be introduced though a nozzle, whose distal opening may be placed proximate the pad, laterally offset from the wafer. The slurry initiates the polishing process by chemically reacting with the film being polished. The polishing process is facilitated by the rotational movement of the pad relative to the wafer (or vice versa) and slurry is provided to the wafer/pad interface.

CMP is popular in most modern semiconductor wafer fabrication processes. For example, CMP is used to planarize tungsten-based interconnect plugs commensurate with the upper surface of the interlevel dielectric. As another example, CMP may be used to planarized fill dielectric placed in shallow trenches, the planarize fill dielectric thereby used as a field dielectric. Accordingly, CMP is principally popular as a planarization tool.

It is oftentimes difficult to control polish rate across the wafer surface. If CMP is used, the polish rate is generally targeted to be equal across raised areas of the wafer surface. However, as the pad conforms to the wafer, or as it bows in an arcuate pattern in response to force applied thereto, the pad will unfortunately remove some portions of the wafer while leaving others. For example, if the pad contacts with more force at the center of the wafer rather than at the wafer perimeter, then too much of the film will be removed at the center relative to the perimeter. A need therefore exists to possibly compensate for dissimilar contact pressures between the pad and the wafer surface. As another example, it might be desirable to remove one or more films at dissimilar rates based on their radial distance from the center of the wafer. A need for this form of removal may stem from misapplication of the thin film, such as would be the case if the thin film accumulated near the perimeter of the wafer surface rather than at the surface. Removing thin film from the outer radial distance relative to the inner radial distance would be beneficial in this case.

An apparatus and process is therefore needed to compensate for disparities at which an abrasive pad contacts and therefore removes material from a wafer surface. A need further exists for removing film material at dissimilar rates to offset films which have previously accumulated at dissimilar thicknesses across the wafer. The desired apparatus and method must therefore selectively remove material and/or film on the wafer surface depending on where that material and/or film resides.

SUMMARY OF THE INVENTION

The problems outlined above are in large part solved by an improved polishing apparatus and method. The present polishing technique purposefully removes materials and/or film thicknesses at dissimilar rates across a substrate. According to one embodiment, the substrate can be a semiconductor wafer. However, it is recognized that the present polishing technique can be applied to a substrate not limited to a semiconductor wafer. Accordingly, whenever "wafer" is referenced hereinbelow, it applies to any material composition which can be polished and is configured as a disk. This includes any device manufactured having a defined thickness and diameter used, for example, in manufacturing or in trade, a suitable disk-shaped wafer includes, for example, a CD-ROM, etc.

More specifically, material may be removed at a faster rate as the distance from the center of the substrate increases, or vice versa. Alternatively, material may be removed at dissimilar rates along one or more concentric rings extending from the center of the substrate, or wafer.

The removal rate can be steadily increased as the radial distance increases, or increased several defined distances from the wafer center. Yet further, the removal rate can be increased, decreased and thereafter increased again as the radial distance increases. It is therefore appreciated that the removal rate can be varied according to numerous permutations to achieve a limitless removal gradient across of two or more concentric ring boundaries along the wafer surface.

Removal rate differential is accomplished by (i) controlling the position of the rotating wafer relative to an oscillating pad, and (ii) delivering fluid to pad locations based on the location's position relative to the center of the pad. Oscillation radius of the pad is limited relative to the overall radius of the wafer. For example, the pad may only oscillate (or orbit) approximately one half inch about a central axis. The central axis is shared by the wafer which rotates about that axis. By limiting the oscillation radius, points of removal on the wafer is dictated primarily by corresponding points on the pad. An "abrasive" point on the pad will abrade an area of the wafer directly above the point and extending approximately a half inch therefrom. Relative to an overall radius of modern wafer sizes, a half inch oscillation is quite small. Coupled with a disparate fluid delivery system, the pad oscillation mated with wafer rotation provides close control of abrasion along one or more concentric rings. The fluid delivery system operates to channel dissimilar fluid flow rates and pressures across the pad backside surface. The pad frontside surface contacts and/or interfaces with the frontside surface of the wafer. The fluid preferably comprises a slurry mixture containing solid particles.

In lieu of the polishing pad, the fluid delivery system can forward pressurized fluid to the frontside surface of the wafer absent a polishing pad therebetween. The fluid is preferably pressured (but not necessarily pressurized) to ablate the wafer surface according to disparate pressure levels across the wafer. Absent a pad, the process is deemed a chemical polish ("CP") and not CMP. In either instance of CP or CMP, surface elevational disparities can be removed at a non-uniform rate depending on the magnitude of those disparities.

Broadly speaking, the present invention contemplates a semiconductor wafer polishing apparatus. The polishing apparatus includes a plurality of apertures spaced from each other through a manifold. Having an inlet port at one end and an opening at an opposing end, the housing is configured to receive the manifold within the opening at the end opposite the inlet port. A conduit is coupled to channel dissimilar fluid flow rates and pressures from the inlet port through the apertures according to the position of those apertures within the manifold.

The polishing apparatus further, or alternatively, contemplates a polishing pad configured within a housing. The housing is adapted for oscillating about a central axis. The semiconductor wafer is brought to contact or interface with the upper surface of the polishing pad. This semiconductor wafer is therefore adapted for rotation about the central axis. A fluid delivery system is connected to a lower surface of the polishing pad to vary fluid across the interface between the semiconductor wafer and the polishing pad. Fluid quantity (i.e., flow rate) and/or pressure is varied relative to changes in the radial distance from the central axis.

BRIEF DESCRIPTION OF THE DRAWINGS

Other objects and advantages of the invention will become apparent upon reading the following detailed description and upon reference to the accompanying drawings in which.

DETAILED DESCRIPTION OF PREFERRED EMBODIMENTS

Figure 1:
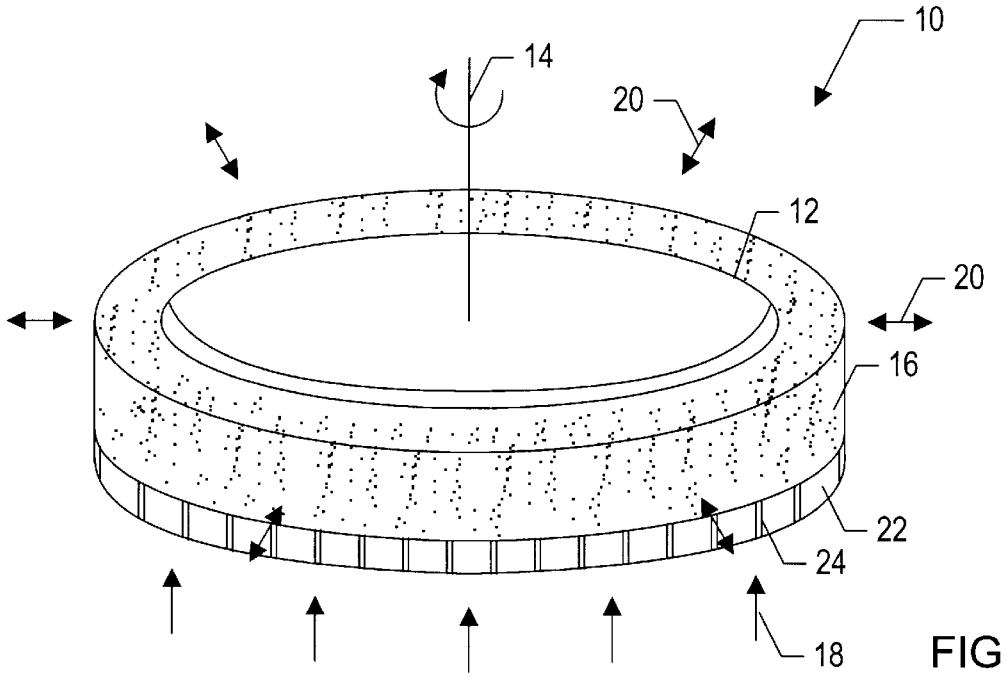
FIG. 1 is a perspective view of a CMP apparatus having an oscillating pad applied to a rotating wafer.

Turning now to the drawings, FIG. 1 provides a perspective view of a CMP apparatus 10. Apparatus 10 includes a wetted polishing surface which can be adapted to bear against a semiconductor wafer 12. Wafer 12 comprises any semiconductive material comprising a plurality of integrated circuits extending across the wafer as "die". CMP apparatus 10 is employed at one or more stages in the fabrication of the integrated circuits. CMP can be used, for example, to remove elevationally raised areas, surface defects, scratches, roughness, contaminants, or embedded particles of dust or dirt. CMP is often referred to as mechanical planarization, but is also utilized to clean the wafer surface to improve the quality and reliability of the ensuing circuit.

In general, CMP involves rotating wafer 12 about an axis 14 while forcing the wetted surface against wafer 12. CMP apparatus 10 includes a polishing pad 16. Polishing pad 16 is made from a relatively porous, soft material, a suitable material being polyurethane. Alternatively, the polishing pad can be made from any hard material which does not conform as much as a polyurethane pad. In either instance, a pad having the various desired composition may be obtained, for example, from Rodel Corporation, as the IC-1000 pad or the Politex pad. The amount of hardness is dictated based on the material being removed and the chemical slurry being used.

Pad 16 is preferably porous and may contain apertures therethrough to allow a slurry mixture to be pumped directly through pad 16 according to arrows 18. The direction of fluid flow 18 is chosen such that it readily extends through pad 16 and impinges on wafer 12 at substantially perpendicular angles absent scattering as it traverses the pad. Pad 16 preferably moves in an orbital direction along a two-dimensional plane. The orbital direction is one which can be deemed as oscillation. Specifically, orbital direction vector is maintained in the two-dimensional plane but changes it back-and-forth movement at incrementally changing vectors. For example, the initial vector may be purely in the positive and negative x directions. Thereafter, the direction vector changes to gradually increase in the y direction relative to the x until it eventually is entirely in the y direction. Thereafter, the vector will continue to increment until again the vector oscillates entirely in the x direction, and so on. The various oscillation vectors are shown in FIG. 1 as reference numerals 20. The amount of movement along the oscillation vectors 20 is substantially limited. Preferably, the back-and-forth movement relative to axis 14 occupies a radial movement from axis 14 less than one inch, and preferably less than one half inch.

Arranged on the bottom surface of pad 16 is a manifold 22. Manifold 22 contains a plurality of apertures which permit passage of fluid (i.e., slurry) through the apertures denoted as reference numerals 24. Apertures 24 receive the polishing fluid, and pass that fluid through pad 16 to the region between pad 16 and wafer 12.

Figure 2:
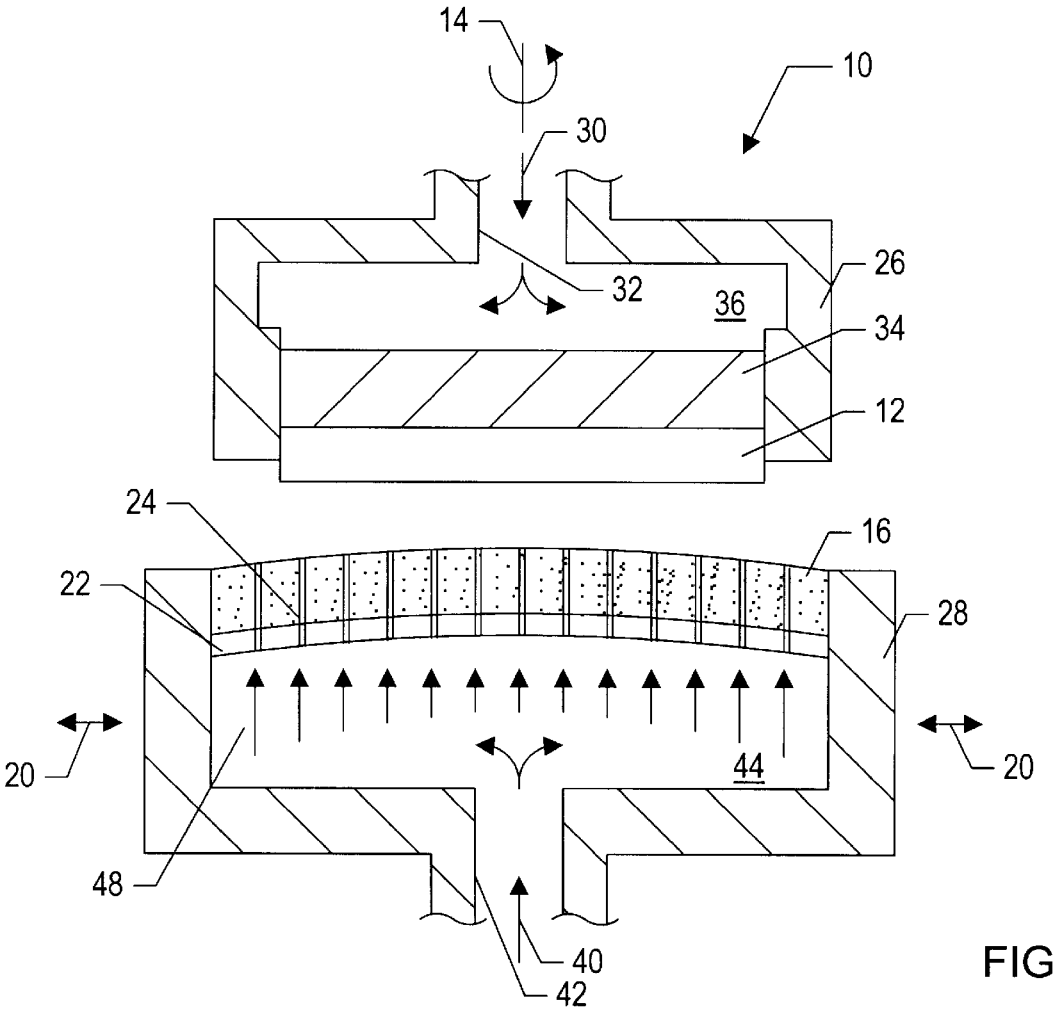
FIG. 2 is a cross-sectional view of the pad, a manifold rearward of the pad, and varying slurry flow rates/pressures applied to the pad to effectuate radially dissimilar removal from a wafer surface.

FIG. 2 illustrates in more detail along a cross-section of CMP apparatus 10. Apparatus 10 carefully and controllably places wafer 12 against pad 16 using a carrier 26 to retain wafer 12 and a housing 28 to retain pad 16. Carrier 26 is used to rotate wafer 12 against pad 16 which is directed upward against the wafer during polishing. An upward force is applied from the pad to the rotating wafer 12. The upward force may be buffered, as desired. For example, the buffered force may comprise air pressure 30 delivered through an inlet port 32 and into a chamber partially encircled by carrier 26. A plate 34 is responsive to the air pressure within chamber 36 by forcing pad 16 in a downward direction when air is present. Air pressure within chamber 36 advantageously serves to buffer or filter transient variations in interface force between pad 16 and wafer 12. In many instances, air pressure within chamber 36 will offset or add to the upward force applied upon pad 16. Wafer 12, regardless of the pressure applied thereto, is retained within carrier 26. The inner surface of carrier 26 retains the outer perimeter surface of wafer 12 to prevent it from slipping laterally during polishing. Thus, polish pressure can be thought of as being applied both through the pad and through the carrier.

Housing 28 serves somewhat the same purpose as carrier 26 in that it retains pad 16. Pad 16 and housing 28 form a chamber which can receive air pressure 40 through an inlet port 42. The air pressure within chamber 44 serves to buffer the upward pressure applied on housing 28 against substrate 12. The combination of air within chambers 36 and 44 help modulate and maintain relatively constant pressure across the entire interface between wafer 12 and pad 16. Placed between pad 16 and chamber 44 is manifold 22. Manifold 22 can be thought of as a relatively thin member, suitably made of aluminum having a plurality of apertures 24 extending entirely through the cross-sectional thickness of manifold 22.

The air pressure and/or fluid extending through inlet port 42 causes manifold 22 and pad 16 to extend upward. In so doing, manifold 22 may flex in an arcuate pattern as shown. Uneven pressure may result in a relatively severe, circular polishing pattern near the center of wafer 12. The circular polishing pattern at or near the center is dictated by the length of oscillation vectors 20. Abrasion primarily at the center region will not produce a desired uniformity across the entire wafer surface. Alternatively, polish only at the center may not remove thicker films which may not exist at the perimeter of the wafer, due to uneven chemical vapor deposition (CVD) or sputter deposition techniques.

To offset the uneven nature by which pad 16 might abrade wafer 12 surface, uneven delivery of slurry may be desired. The uneven fluid delivery is shown as reference numeral 48, where the length of arrows indicate a greater channeling of fluid flow and pressure to the outer perimeter of pad 16 relative to the center of pad 16. The result of uneven fluid delivery is to accumulate more fluid (or slurry) at the perimeter of the wafer rather than at the center to offset possibly greater abrasive force of an arcuate pad applied at the center as shown.

It is believed that by directing slurry with sufficient force at the out perimeter of the wafer, more wafer will be removed at those perimeter positions and relatively little slurry forwarded at the center of the wafer. The fluid delivery non-uniformity is shown in FIG. 2 to offset the abrasive pad-wafer contact nonuniformity.

Figure 3:
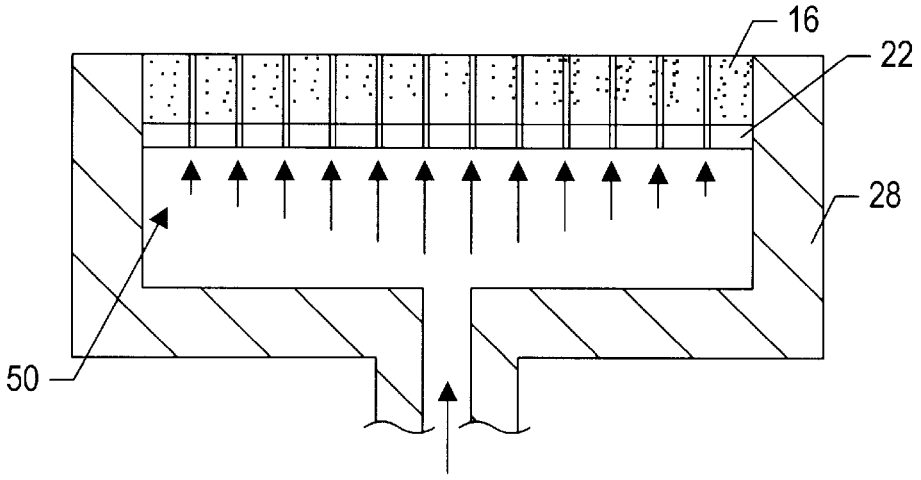
FIG. 3 is a cross-sectional view of the pad, grid and second radially dissimilar flow rate/pressure applied through various portions of the pad and manifold according to another embodiment.

FIG. 3 illustrates instances where pad 16 may not necessarily bow upward if minimal polish pressure is applied through pad 16. This is contrary to that shown in FIG. 2. Instead, pad 16 maintains a relatively planar upper surface when brought to bear against a wafer. It might be desirable in many instances to apply more fluid to the center of the wafer then at the perimeter. Vectors 50 illustrate fluid flow and pressure differentials. The fluid flow and pressure differentials may be selected to remove more surface material at the center of the wafer, with gradual decrease as radial position extends to the perimeter of the wafer.

Figure 4:
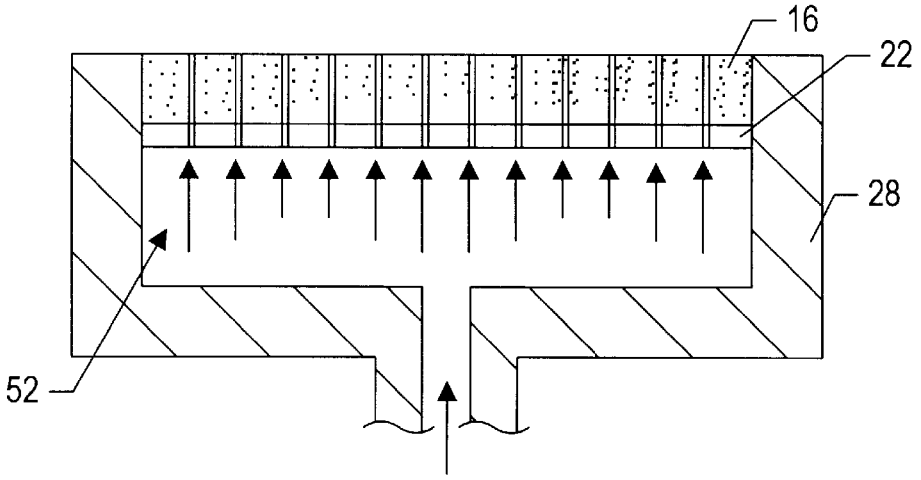
FIG. 4 is a cross-sectional view of the pad, grid and third radially dissimilar flow rate/pressure applied through various portions of the pad and manifold according to yet another embodiment.

FIG. 4 illustrates yet another embodiment in which fluid flow and pressure vectors 52 change according to their radial position to form removal rate differentials across concentric rings of the wafer. Removal rate vectors 48, 50 and 52 (shown in FIGS. 2, 3 and 4) indicate greater removal along larger arrows than smaller arrows. Vector 52 indicates a removal rate at the center to be relatively high, decreasing towards the perimeter and the increasing again at the perimeter.

Figure 5:
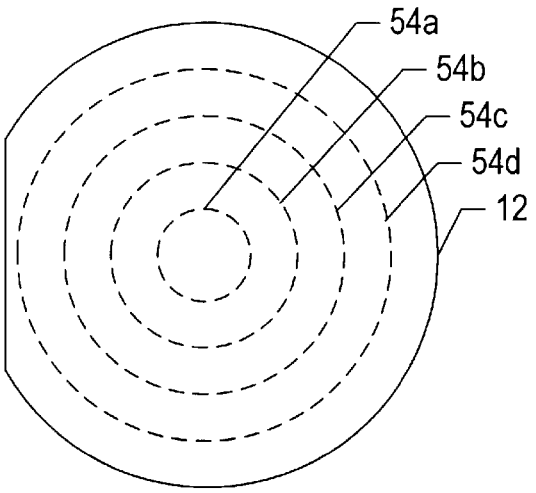
FIG. 5 is a plan view of a wafer surface polished at dissimilar amounts along concentric rings of the wafer surface.

FIG. 5 illustrates multiple concentric rings 54 of removal rate differentials formed across the surface of wafer 12. Removal ring 54*a* may, for example, indicate substantial removal within that area. The ring indicated by numeral 54*b*, outside area 54*a*, may indicate a lessened removal rate, relative to area 54*a*. The number of permutations at which removal rate differences can occur in radial directions is almost limitless based on the number of rings and dissimilar removal rates amongst those rings.

Figure 6:
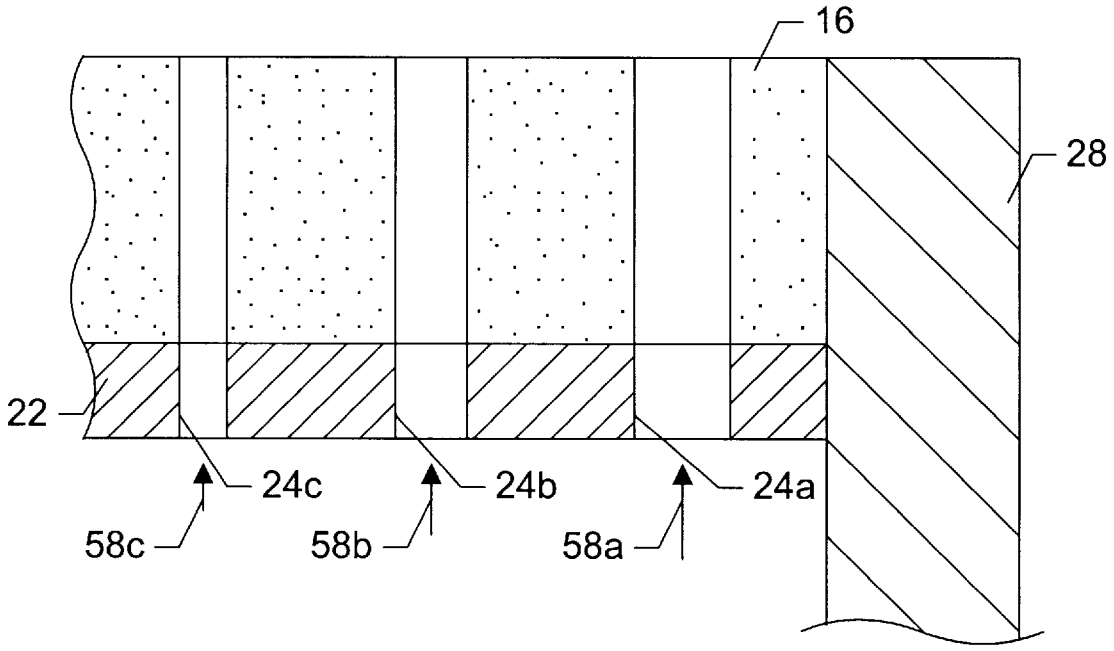
FIG. 6 is a detail cross-sectional view of a partial pad and grid having dissimilar sized apertures within the manifold for receiving dissimilar flow rate/pressure therethrough.

FIG. 6 is a detailed cross-sectional view of a partial pad and manifold region. According to one embodiment, manifold 22 contains apertures 24 which are of dissimilar size. Apertures 24 have larger or smaller openings depending on whether a greater or lesser amount of fluid, respectively, is to pass. As shown, aperture 24*a* is larger than aperture 24*b*, and aperture 24*b* is larger than aperture 24*c*. This allows for a greater flow rate and pressure of fluid passing through aperture 24*a* than aperture 24*c*. The fluid flow and pressure rate differential is shown with dissimilar arrow lengths indicative of that differential as reference numerals 58*a* through 58*c*. A larger aperture 24*a* allows greater fluid amounts and pressures to extend through pad 16 directly above the aperture. This forces the fluid to locally etch the wafer surface near the perimeter (i.e., above aperture 24*a*) relative to the wafer surface near the center (i.e., above apertures 24*b* and 24*c*).

Figure 7:
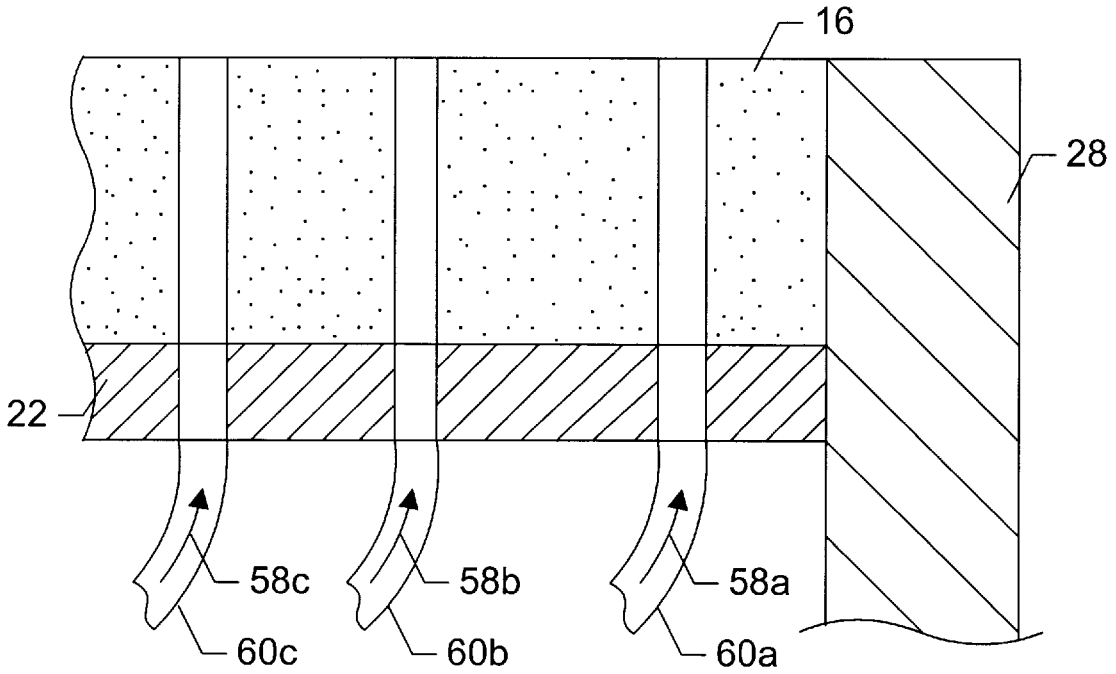
FIG. 7 is a detail cross-sectional view of a partial pad and grid having dissimilar ports connected to apertures within the manifold for receiving dissimilar flow rate/pressure therethrough.

FIG. 7 illustrates and alternative embodiment in which apertures 24 are of the same size, however, tubes or ports 60 are connected to the aperture, each bearing fluid which passes therethrough at dissimilar flow rates and/or pressures. A greater pressure/flow 58*a* is within tube 60*a* than the pressure/flow 58*b* and 58*c* within tubes 60*b* and 60*c*, respectively. By affixing tubes of the same diameter to apertures of the same diameter, yet changing the flow/pressure within those tubes allows the same differential to occur across pad 16 and ultimately across the wafer surface, similar to the embodiment shown in FIG. 6. Thus, tubes 60 extend through the chamber between manifold 22 and housing 28 such that the fluid delivery is external to air delivery at the backside surface of manifold 22. Accordingly, FIG. 7 proposes separation of fluid and air delivery, whereas FIG. 6 may, if needed, combine the two.

Figure 8:
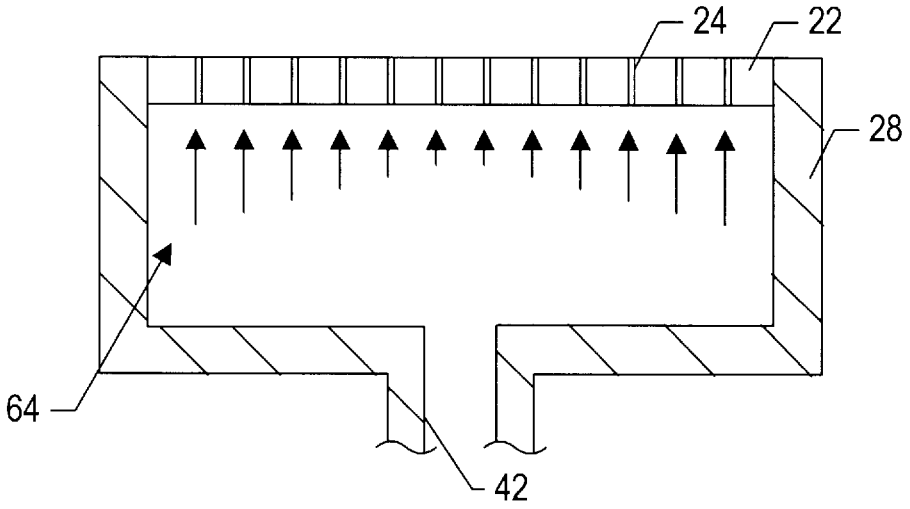
FIG. 8 is cross-sectional view of a CP system with radially varying flow rate/pressure applied through the manifold absent the pad according to yet a further embodiment.

FIG. 8 illustrates yet another embodiment in which the polishing pad is removed. Instead of having a polishing pad, the flow rate and pressure of fluid being delivered directly removes wafer surface material. When using a polishing pad, both the mechanical abrasion of the pad in combination with fluid delivery etches the wafer surface at select regions. Manifold 22 may be securely mounted to housing 28 since need for its upward movement is eliminated absent the pad. Varying fluid delivery rates through manifold 28 is adjusted by changing the opening size of apertures 24 within manifold 22. Shown in FIG. 8 is a greater flow and pressure amount forwarded through apertures 24 near the perimeter of manifold 22 rather than at the center. The larger arrows are indicative of the greater flow and pressure amounts relative to the smaller arrows, denoted as reference numeral 64.

FIG. 8 generally depicts a chemical polish (or CP) technique. The fluid itself, when impinging on the wafer surface dislodges the outer surface materials being impinged. The fluid can be a slurry material and can contain various etch components. For example, the slurry can comprise silica particles and deionized water, along with possibly potassium hydroxide as the active element. The slurry can be suitably obtained from, for example, Cabot Corporation. The active agent can be, in lieu of for example potassium hydroxide, potassium dichromate, potassium iodate, potassium ferricyanide, potassium bromate, and/or vandium trioxide. The fluid may, in some instances, not contain silica particles or an active agent. Instead, the fluid may simply be deionized water pressure delivered upon the wafer.

Figure 9:
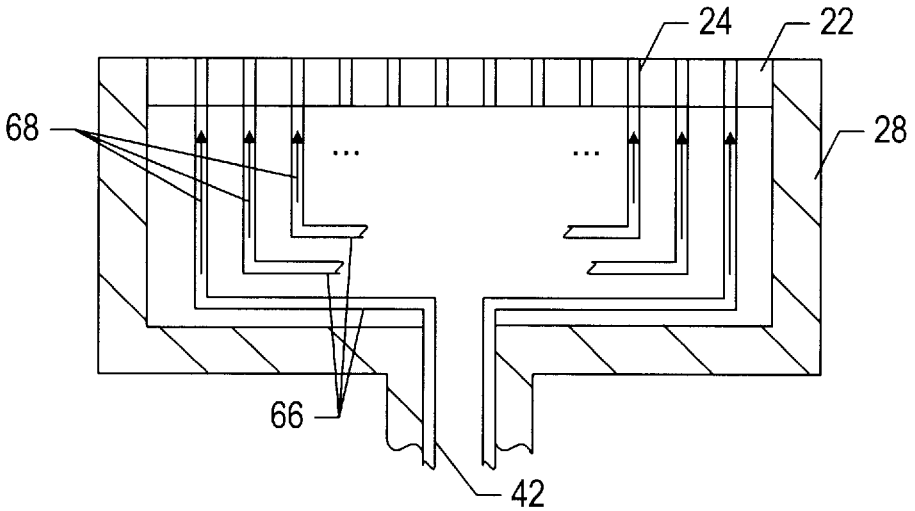
FIG. 9 is a cross-sectional view of a CP system with radially varying flow rate/pressure applied through nozzles directed to the wafer surface absent the pad according to still a further embodiment.

FIG. 9 illustrates a CP process where, in lieu of changing aperture sizes, the apertures remain the same in diameter. Yet, tubes 66 are affixed to the inner surfaces of apertures 24. Tubes 66 contain fluid delivered through apertures 24 at dissimilar flow rates and/or pressures, denoted as reference numeral 68. Tubes 66 extend from respective apertures 24 through inlet port 42. Accordingly, inlet ports 42 may require enlargement to accommodate numerous tubes 66.

It will be appreciated to those skilled in the art having the benefit of this disclosure that this invention is believed to be capable of removing material and/or film from an upper surface of a semiconductor wafer. The fluid delivery system can be adapted to be placed with or without an abrasive pad. Fluid is delivered at dissimilar pressures and flow rates as the radial distance from the center of the wafer increases across the wafer. It is intended that the following claims be interpreted to embrace all such modifications and changes and, accordingly, the specification and drawings are to be regarded in an illustrative rather than a restrictive sense.

What is claimed is:

1. A semiconductor wafer polishing apparatus, comprising:

a plurality of apertures spaced from each other through a manifold;

a housing having an inlet port at one end and an opening configured to receive the manifold at another end opposite the inlet port; and a conduit for channeling dissimilar fluid flow rates and pressures from the inlet port and through the apertures according to their position within said manifold.

2. The polishing apparatus as recited in claim 1, wherein said manifold is circular about a central axis.

3. The polishing apparatus as recited in claim 2, wherein said conduit comprises a chamber bound by said housing and said manifold, and wherein said chamber operably receives fluid from said inlet port through said apertures which are dissimilarly sized according to their position relative to said central axis.

4. The polishing apparatus as recited in claim 3, wherein said apertures increase in size as the distance from the central axis increases.

5. The polishing apparatus as recited in claim 3, wherein said apertures decrease in size as the distance from the central axis increases.

6. The polishing apparatus as recited in claim 3, wherein said apertures increase and then decrease in size as the distance from the central axis increases.

7. The polishing apparatus as recited in claim 3, wherein said apertures decrease and then increase in size as the distance from the central axis increases.

8. The polishing apparatus as recited in claim 2, wherein said conduit comprises a plurality of tubes extending from the inlet port to respective apertures.

9. The polishing apparatus as recited in claim 8, wherein fluid flow rates and pressures within said conduit increase as the distance from the central axis increases.

10. The polishing apparatus as recited in claim 8, wherein fluid flow rates and pressures within said conduit decreases as the distance from the central axis increases.

11. The polishing apparatus as recited in claim 8, wherein fluid flow rates and pressures within said conduit increase and then decrease as the distance from the central axis increases.

12. The polishing apparatus as recited in claim 8, wherein fluid flow rates and pressures within said conduit decrease and then increase as the distance from the central axis increases.

13. The polishing apparatus as recited in claim 1, further comprising a porous, substantially conformal pad abutting against a side of said manifold opposite said conduit.

14. The polishing apparatus as recited in claim 13, wherein an outer perimeter of said manifold abuts a first inner surface portion of said housing, and said outer perimeter of said pad abuts a second inner surface portion of said housing, and wherein said first inner surface portion is aligned vertically with said second inner surface portion closer to said inlet port than said second inner surface portion.

15. The polishing apparatus as recited in claim 1, wherein said fluid comprises a slurry of silicon-based particles entrained within a liquid solution.

16. A semiconductor wafer polishing apparatus, comprising:

a polishing pad configured within a housing, wherein the housing is adapted to be oscillated about a central axis;

a carrier configured to hold a semiconductor wafer and to interface the semiconductor wafer with an upper surface of said polishing pad, wherein the semiconductor wafer is adapted for rotation about the central axis; and a fluid delivery system connected to a lower surface of said polishing pad in variable fluid communication with the interface between the semiconductor wafer and the polishing pad relative to changes in radial distances from the central axis.

17. The polishing apparatus as recited in claim 16, wherein said fluid delivery system comprises:

an inlet port extending from a fluid source to an interior of said housing; and a manifold placed within said housing between said inlet port and the lower surface of said polishing pad.

18. The polishing apparatus as recited in claim 17, wherein said manifold comprises a plurality of apertures spaced from each other through the manifold.

19. The polishing apparatus as recited in claim 18, wherein said apertures vary in inner diameter depending on their location relative to the central axis.

20. The polishing apparatus as recited in claim 17, wherein said manifold houses a plurality of pressure-delivery nozzles arranged on respective tubes which extend from the inlet port.

21. The polishing apparatus as recited in claim 16, wherein said fluid delivery system, in combination with said pad, is configured to remove material from a surface of the semiconductor wafer dependent upon the radial location of the material from a center of said semiconductor wafer.

* * * * *